US008376570B2

(12) United States Patent
Kennedy et al.

(10) Patent No.: US 8,376,570 B2
(45) Date of Patent: Feb. 19, 2013

(54) COORDINATED FEEDBACK ROTATIONAL SWITCHING MECHANISM AND MODULAR ILLUMINATION SYSTEM

(75) Inventors: Douglas Kennedy, Moab, UT (US); Greg Kennedy, Moab, UT (US)

(73) Assignee: Tactical Lighting Solutions, LLC, Moab, UT (US)

( * ) Notice: Subject to any disclaimer, the term of this patent is extended or adjusted under 35 U.S.C. 154(b) by 504 days.

(21) Appl. No.: 12/612,803

(22) Filed: Nov. 5, 2009

(65) Prior Publication Data

US 2011/0103048 A1 May 5, 2011

(51) Int. Cl.
*F21L 4/04* (2006.01)

(52) U.S. Cl. ..... 362/205; 362/202; 362/199; 362/196

(58) Field of Classification Search ..... 362/98, 362/99, 102–120, 184, 194–198, 200, 202, 362/203, 205, 647, 649, 650, 212, 213, 477, 362/199

See application file for complete search history.

(56) References Cited

U.S. PATENT DOCUMENTS 4,905,130 A 2/1990 Huang
5,345,370 A * 9/1994 Murray et al. ..... 362/205
6,045,236 A 4/2000 Cheng
6,099,141 A * 8/2000 Landamia ..... 362/184
7,281,815 B1 * 10/2007 Gustafson et al. ..... 362/206
2004/0105258 A1 * 6/2004 Galli ..... 362/205
2006/0133075 A1 6/2006 Huang
2007/0177378 A1 8/2007 Wu et al.
2010/0039801 A1 * 2/2010 Pelletier et al. ..... 362/184

* cited by examiner

*Primary Examiner* — Evan Dzierzynski
*Assistant Examiner* — Danielle Allen
(74) *Attorney, Agent, or Firm* — Baker & Associates PLLC; Trent H. Baker

(57) ABSTRACT

A portable illumination system comprising distal and proximal members rotatably coupled to one another. The rotatable coupling between the members includes resistive rotational feedback across a plurality of independent rotational regions between the members. A rotational switching mechanism is configured to switch between an activated state and a deactivated state. The activated state includes an electrical coupling between an electrical power source and an electro-optical output device across a plurality of independent rotational regions between the members. The plurality of independent rotational regions of the activated state corresponds to a linear or lengthwise alignment between the distal activated indicator and the activated proximal indicator. The plurality of independent rotational regions of the resistive rotational feedback may be coordinated with the plurality of independent rotational regions of the activated state. A second alternative embodiment of the portable illumination system includes a rotational switching mechanism with an electrical switching system and an operationally independent resistance system.

20 Claims, 9 Drawing Sheets

COORDINATED FEEDBACK ROTATIONAL SWITCHING MECHANISM AND MODULAR ILLUMINATION SYSTEM

FIELD OF THE INVENTION

The invention generally relates to switching mechanisms utilized in conjunction with portable optical illumination systems. In particular, the present invention relates to a coordinated feedback rotational switching mechanism for use in conjunction with a portable electrical illumination system.

BACKGROUND OF THE INVENTION

Portable optical illumination systems selectively provide a region of illumination or optical output that may be used for a variety of purposes. The illuminated region may include various forms of visual or non-visual light for various tasks such as manual operation and/or position designation. For example, a headlamp is a portable optical illumination system designed to be worn on a user's head and is configured to visibly illuminate a selected region in front of the user for manual purposes such as walking or reading at night. Likewise, a flashlight is a handheld portable optical illumination system which optically illuminates a region to enable a user to visualize items within the region. Both headlamps and flashlights are sized to be portable to allow users to bring them to a variety of locations without adding undue weight or size.

Portable optical illumination systems include a switching mechanism to allow a user to selectively activate the illumination source. For example, electrical-based systems include a switching mechanism that selectively connects the electrical pathway between an electrical power source such as a battery, and an electrical optical output device such as a light emitting diode. One type of electrical switching mechanism utilized on conventional portable illumination system is rotationally oriented in that the manual operation of the electrical switch includes a rotational movement to selectively activate the illumination system. For example, rotational switching mechanisms may incorporate a rotational movement between two portions of the external housing of the portable optical illumination system. The rotational movement may be transverse to the optical illumination path to enable a user to selectively illuminate a region without physically obscuring optical output during the switching operation.

Conventional rotational switching mechanisms are limited in their operation. For example, the rotational switching mechanism commonly incorporated on most cylindrical flashlight type products utilizes a clockwise activation and counter-clockwise deactivation between a distal housing portion and the remainder of the system. Unfortunately, the same clockwise and clockwise-counter movements are often utilized to remove the distal-most housing portion from the system to enable access and/or replacement of the illumination output device and/or electrical power source. Therefore, a user may unintentionally disengage the distal most portion from the system while intending to merely deactivate the switching mechanism. In addition, most rotational switching mechanisms provide limited feedback to the user during operation, thereby forcing the user to rely on the illumination output as the only feedback. For example, a user may intuitively rotate the distal-most housing portion clockwise relative to the remainder of the system until the illumination output is activated. Likewise, the user may rotate the distal-most housing portion counter-clockwise relative to the remainder of the system until the illumination output is deactivated. This type of output-based feedback is unreliable and may cause unintended switching and/or disassembly of the system.

Further, the internal electrical configuration limits the switching functionality for the operation of the overall illumination system. In general, conventional rotational switching mechanisms require the distal-most housing to be screwed/rotated toward the remainder of the system (usually clockwise) so as to electrically engage/contact respective conductive members. The electrical engagement enables electrical current from the electrical power source to be transmitted to the optical output device, thereby activating the system. However, this electrical configuration is significantly limited to unidirectional rotational operation and single-activated-mode operation. A user may only electrically activate/switch the system in one direction so as to coincide with mechanically translating the distal most housing portion toward the remainder of the system. Single mode operation means that the switching mechanism is limited to a single on-off type mechanism or limited multi-mode operational functionality. For example, a unidirectional multi-mode system may always require a user to rotate clockwise to switch between modes 2 and 3. Likewise, a unidirectional multi-mode system may prevent single step switching between certain modes.

There is a need in the industry for rotational switching mechanisms that overcome these limitations to provide improved performance, reliability, and functionality to portable illumination systems.

SUMMARY OF THE INVENTION

The present invention relates to switching mechanisms utilized in conjunction with portable optical illumination systems. One embodiment of the present invention relates to a portable illumination system comprising distal and proximal members rotatably coupled to one another. The distal and proximal members may each include tactile activated and deactivated indicators. The rotatable coupling between the members includes resistive rotational feedback across a plurality of independent rotational regions between the members. A rotational switching mechanism is configured to switch between an activated state and a deactivated state. The activated state includes an electrical coupling between an electrical power source and an electro-optical output device across a plurality of independent rotational regions between the members. The plurality of independent rotational regions of the activated state corresponds to a linear or lengthwise alignment between the distal activated indicator and the activated proximal indicator. The plurality of independent rotational regions of the resistive rotational feedback may be coordinated with the plurality of independent rotational regions of the activated state. A second alternative embodiment of the portable illumination system includes a rotational switching mechanism with an electrical switching system and an operationally independent resistance system. The electrical switching system defines a plurality of rotational regions between the members corresponding to the activated state, and the resistance system defines a plurality of rotational regions between the members at which resistive rotational feedback is generated between the members. The plurality of rotational regions defined by the resistance system are coordinated with the plurality of rotational regions defined by the electrical switching system so as to rotationally preempt and follow the plurality of rotational regions corresponding to the activated state. A third embodiment of the present invention relates to a method for rotationally activating a portable illumination system, including rotating members relative to one another, thus inducing a rotational resistance between the members and engaging an activated electrical state that produces an optical output.

Embodiments of the present invention represent a significant advance in the field of illumination systems on portable articles having an enclosed interior region. Prior art illumination systems fail to effectively coordinate electrical operation with either rotational resistance or exterior tactile indicators. Embodiments of the present invention coordinate resistive feedback with electrical operation to enable a user to feel the activation and/or deactivation of specific electrical operational states such as ON or OFF. Likewise, embodiments of the present invention coordinate the linear/lengthwise alignment of external tactile indicators with the electrical operation to enable a user to further feel the activation and/or deactivation of specific electrical operational states. Prior art illumination systems which include any form of resistive rotational feedback utilize an operationally codependent system in which the rotational resistive feedback is generated by the same internal components to those which perform the electrical switching functionality. For example, a bell shaped radial spring is utilized for both the electrical coupling and the incidental rotational resistance felt by a user upon engagement of the electrical coupling. However, the operational dependence between the resistance mechanism (the spring) and the electrical switching mechanism (the spring) limits the resistive feedback profile and the reliability to properly induce the resistive feedback. In addition, the operational dependence of the rotational switching mechanism may result in a unidirectionally (i.e. in the clockwise direction) limited switching functionality which prevents flexibility in single step switching in multi-mode systems. For example, in a three mode unidirectional system, a user is prevented from switching between modes 1 and 3 in a single step without engaging mode 2. Embodiments of the present invention include a rotational switching mechanism with an electrical switching system that is operationally independent of the resistance system. Therefore, a resistive feedback profile can more effectively induce rotational resistance before and after an electrical state is activated. Likewise, the operational independence allows for a bidirectional rotational operation in that activation of any state may occur in both the clockwise and counterclockwise directions.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

Figure 1:
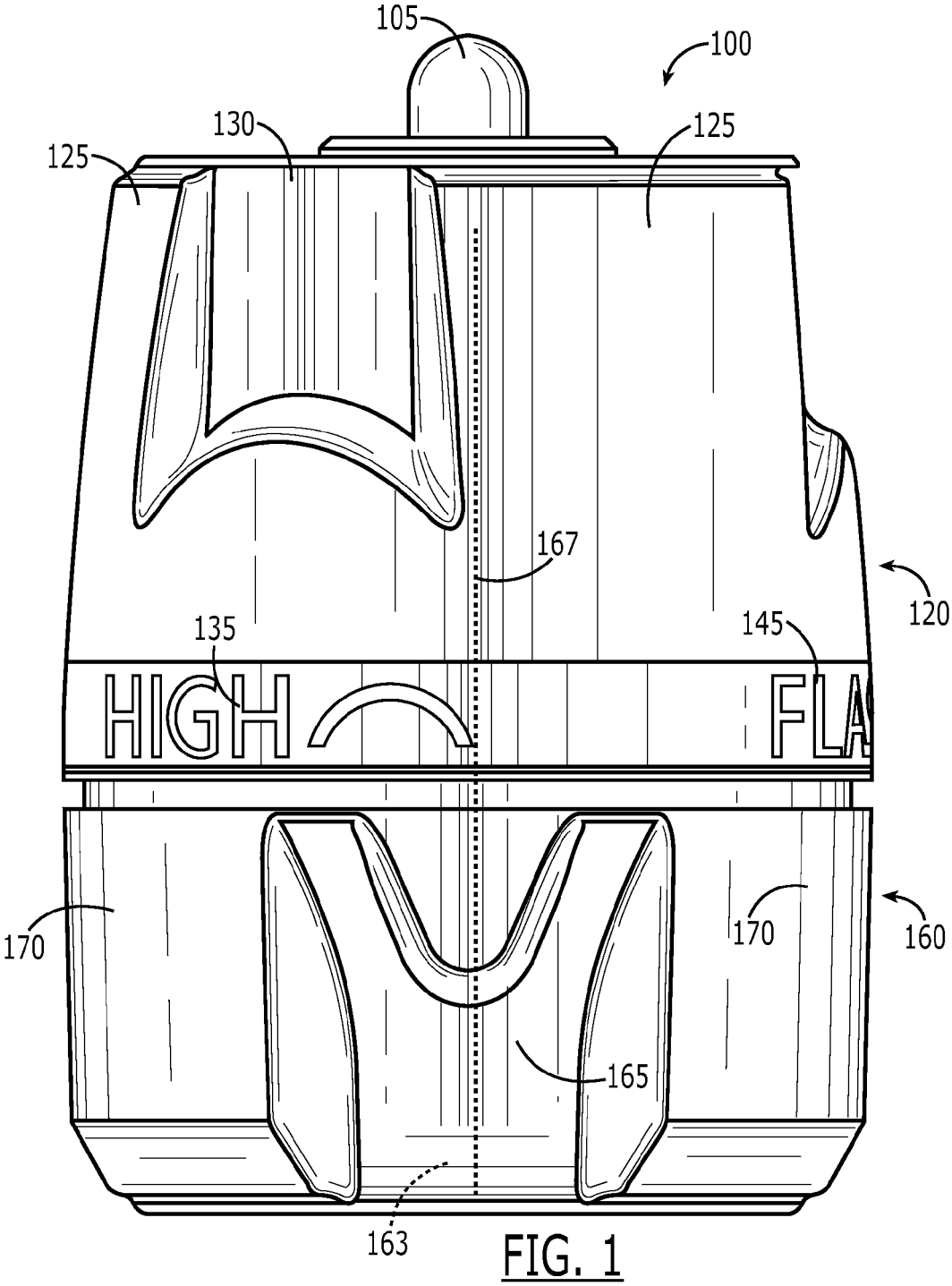
FIG. 1 illustrates a profile view of a portable illumination system including a rotational switching mechanism in accordance with embodiments of the present invention.

The present invention relates to switching mechanisms utilized in conjunction with portable optical illumination systems. One embodiment of the present invention relates to a portable illumination system comprising distal and proximal members rotatably coupled to one another. The distal and proximal members may each include tactile activated and deactivated indicators. The rotatable coupling between the members includes resistive rotational feedback across a plurality of independent rotational regions between the members. A rotational switching mechanism is configured to switch between an activated state and a deactivated state. The activated state includes an electrical coupling between an electrical power source and an electro-optical output device across a plurality of independent rotational regions between the members. The plurality of independent rotational regions of the activated state corresponds to a linear or lengthwise alignment between the distal activated indicator and the activated proximal indicator. The plurality of independent rotational regions of the resistive rotational feedback may be coordinated with the plurality of independent rotational regions of the activated state. A second alternative embodiment of the portable illumination system includes a rotational switching mechanism with an electrical switching system and an operationally independent resistance system. The electrical switching system defines a plurality of rotational regions between the members corresponding to the activated state, and the resistance system defines a plurality of rotational regions between the members at which resistive rotational feedback is generated between the members. The plurality of rotational regions defined by the resistance system are coordinated with the plurality of rotational regions defined by the electrical switching system so as to rotationally preempt and follow the plurality of rotational regions corresponding to the activated state. A third embodiment of the present invention relates to a method for rotationally activating a portable illumination system, including rotating members relative to one another, thus inducing a rotational resistance between the members and engaging an activated electrical state that produces an optical output. Also, while embodiments are described in reference to a rotational switching mechanism for use in conjunction with a portable illumination system, it will be appreciated that the teachings of the present invention are applicable to other areas.

The following terms are defined as follows:

Portable illumination system—A system capable of generating an optical output with an overall form factor consistent with reasonable portability. For example, a headlamp, flashlight, a semiconductor-based laser pointer, etc. may all be referred to as portable illumination systems.

Tactile indicator—a region on an exterior surface having a particular three dimensional geometry so as to be distinguishable from the remainder of the exterior surface. For example, a letter or word written in the brail language comprises one or more tactile indicators. A tactile indicator may include both positive raised regions and/or negative recessed regions. A tactile indicator may also refer to a particular operational configuration such as an activated tactile indicator that corresponds to an activated or illuminated state of an illumination system.

Linear alignment—an alignment between two regions along a particular line. For purposes of this application, the phrase "linear alignment" is used to describe the lengthwise alignment of regions of two members which rotate relative to one another. Therefore, a rotational orientation between the two members in which particular regions are aligned on the corresponding exterior surfaces will be referred to as being linearly aligned.

Rotational regions—radial regions of rotation between two objects. Therefore, two objects configured to rotate with respect to one another about a common rotatable coupling include a 360 degree rotational region. A rotational region is illustrated in conjunction with the present application to refer to relative positions between two rotatably coupled members.

Resistive feedback—A form of resistance received by a user during operation of a particular system. One type of resistive feedback is rotational resistance in a system that utilizes rotation to switch on and off the operation of a particular function. As one member is rotated with respect to another member, rotational resistance presents an opposing force increasing the torque necessary to rotate the one member relative to the other. This may be referred to as feedback in that the user feels the increased and/or decreased rotational resistance across a particular relative rotational region between the members.

Rotationally preempt—Along a single rotational direction, one event rotationally occurring before a second event may be referred to rotationally preempting the second event. For example, as one member is rotated with respect to another member in a single rotational direction, a rotational resistance may be felt by a user before an electrical switching mechanism activates an illumination output. Therefore, if a user ceases to rotate at a point at which the rotational resistance is felt, the electrical switching mechanism may not have yet activated the illumination output because the rotational resistance rotationally preempts the electrical activation. It will be appreciated that events may occur at overlapping rotational regions such that independent events occur in part simultaneously.

Rotationally follow—Along a single rotational direction, one event rotationally occurring after a second event may be referred to as rotationally following the second event. This phrase is analogous to rotationally preempt, and the examples described above are thereby applicable.

Bell shaped—A region having a bell shaped curvature. The region may be part of a physical structure or a rotational region corresponding to a set of positions between two rotatably coupled members.

Electrical storage device—a device configured to store electrical current including but not limited to a battery and associated circuitry.

Electro-optical device—a device configured to receive an electrical input and product an optical output including but not limited to a light emitting diode, lamp, etc.

Operationally dependence/independence—the interdependence of two operational systems which may be disposed within one device. For example, the seatbelt buckle mechanism in a motor vehicle is operationally independent of the electrical system. Whereas, the audio system in a motor vehicle is operationally dependent with the electrical system because a failure in the electrical system (i.e. battery or alternator) may result in a failure in the audio system. Therefore, systems which are operationally independent of one another are not dependent for their operation even though they may be disposed within the same vicinity or operate simultaneously.

Figure 2:
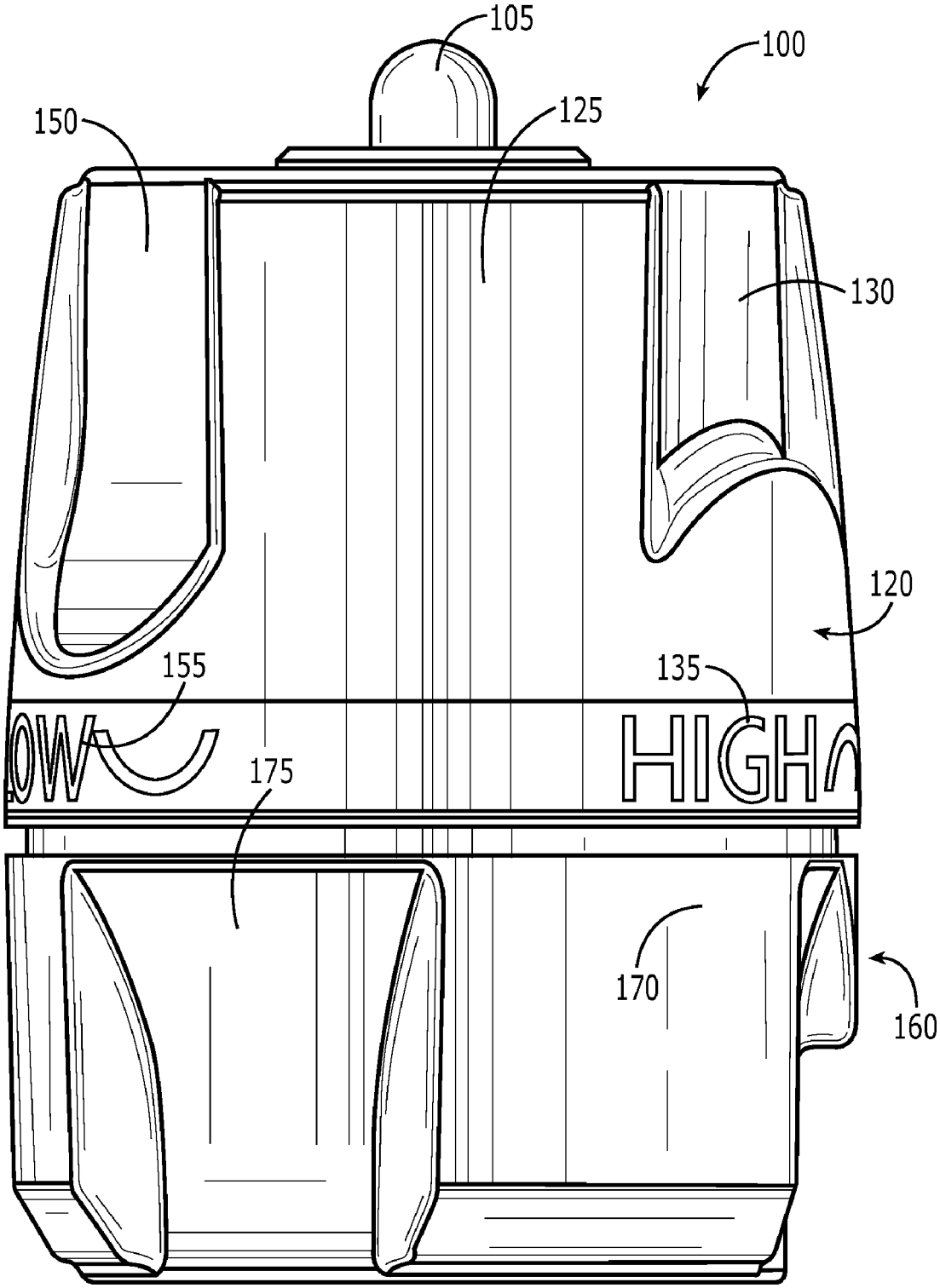
FIG. 2 illustrates an alternative profile view of the portable illumination system of FIG. 1.
Figure 3:
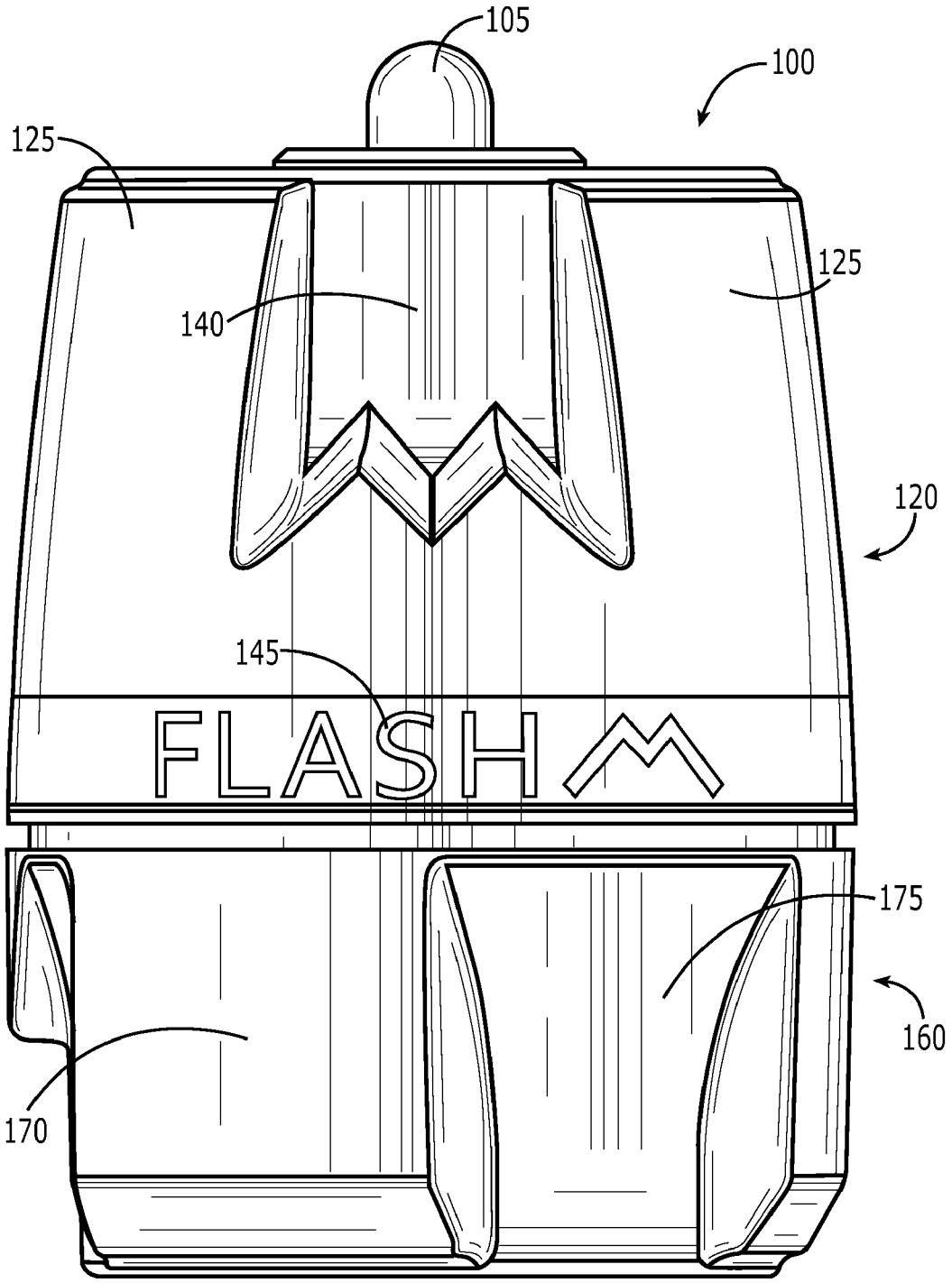
FIG. 3 illustrates a second alternative profile view of the portable illumination system of FIG. 1.

Reference is initially made to FIGS. 1-3, which illustrate profile views of a portable illumination system including a rotational switching mechanism, designated generally at 100. FIGS. 1-3 represent alternative profile views of the same cylindrical system 100 in the same operational and rotational configuration so as to properly illustrate the entire circumferential exterior surfaces of the corresponding cylindrical components. The system 100 comprises a distal member 120, a proximal member 160, a rotational switching mechanism 200, 250 (see FIGS. 6-7), an electro-optical output device 105, and an electrical storage device 163. The terms distal and proximal are used to designate the relative positions of components with respect to user operation and illumination output. The electro-optical output device 105 is the distal most component in the illustrated configuration. Although the illustrated proximal and distal members 120, 160 are substantially cross-sectionally circular and/or cylindrical, it will be appreciated that alternative lengthwise cross-sectional shapes may include but are not limited to square, hexagon, oval, rectangle, etc. The members 120, 160 each include exterior surfaces with a plurality of indicators disposed across particular curved regions of the exterior surfaces. The indicators represent various modes or states of the system 100, but it will be appreciated that any alternative indicator scheme may be utilized and remain consistent with the teachings of the present invention. The members 120, 160 are rotatably coupled to one another in a lengthwise orientation such that the exterior curvatures are substantially transversely aligned with one another. Therefore, the exterior curvatures of the members 120, 160 are substantially parallel in the lengthwise (vertically illustrated in FIGS. 1-3) orientation. Because of the relative shapes, rotatable coupling orientation, and transverse alignment of the members 120, 160, the exterior curvatures will remain substantially transversely aligned with one another in any corresponding rotational configuration between the members 120, 160 so as to maintain an overall cylindrically shaped system 100. For purposes of clarity, the relative rotational positioning between the exterior surfaces of the members 120, 160 will be referred to as linear or lengthwise alignment.

The distal member 120 may further include a first distal activated tactile indicator 130, a second distal activated tactile indicator 140, a third distal activated tactile indicator 150, a distal deactived tactile indicator 125, a first distal activated visual indicator 135, a second distal activated visual indicator 145, a third distal activated visual indicator 155. The tactile indicators 130, 140, 150 are radially separated from one another across particular transverse regions of the exterior surface of the distal member 120, as illustrated. The corresponding tactile and visual indicators are linearly aligned with one another across particular transverse regions of the distal member 120. The distal visual indicators 135, 145, 155 are optional components which may be attached to a common ring member externally coupled around the distal member 120; the common ring member may rotate with respect to the distal member 120, 160 over time and therefore no longer properly align with the corresponding tactical indicators. The first distal activated tactile indicator 130 includes a three dimensionally recessed region with a distal oriented convex curvature. The first distal activated visual indicator 135 includes the word HIGH and an image of a distal oriented convex line. The second distal activated tactile indicator 140 includes a three dimensionally recessed region with a jagged structure. The second distal activated visual indicator 145 includes the word FLASH and an image of a jagged line. The third distal activated tactile indicator 150 includes a three dimensionally recessed region with a concave distal oriented curvature. The third distal activated tactile visual indicator 155 includes the word LOW and an image of a distal oriented concave line. The distal tactile deactivated indicator 125 is a three dimensionally smooth region across the distal member 120.

The proximal member 160 further includes a proximal activated tactile indicator 165, a first proximal deactivated tactile indicator 170, and a second proximal deactivated tactile indicator 175. The proximal activated tactile indicator 165 includes a three dimensionally recesses region with the distal oriented concave curvature having a particular apex. The apex corresponds to a narrowly defined linear/lengthwise activation region 167 illustrated by the designated dashed line. The relative rotational positioning of the apex of the proximal activated tactile indicator with respect to exterior surface the distal member 120 corresponds to the mode/state of the system 100. The operation and specific configurations of this rotational alignment will be described in more detail below. In FIG. 1, the relative rotational positioning of the members 120, 160 is such that the activation region 167 is misaligned but adjacent to the first activated tactile and visual indicator 130, 135. The effect of a particular alignment, misalignment, adjacency, etc. of the activation region 167 will be discussed further below and in particular reference to the illustrated radial profile diagram of FIG. 5. The first proximal deactivated tactile indicator 170 includes a three dimensionally smooth region, and the second proximal deactivated tactile indicator 175 includes a three dimensionally recessed region.

Figure 4A:
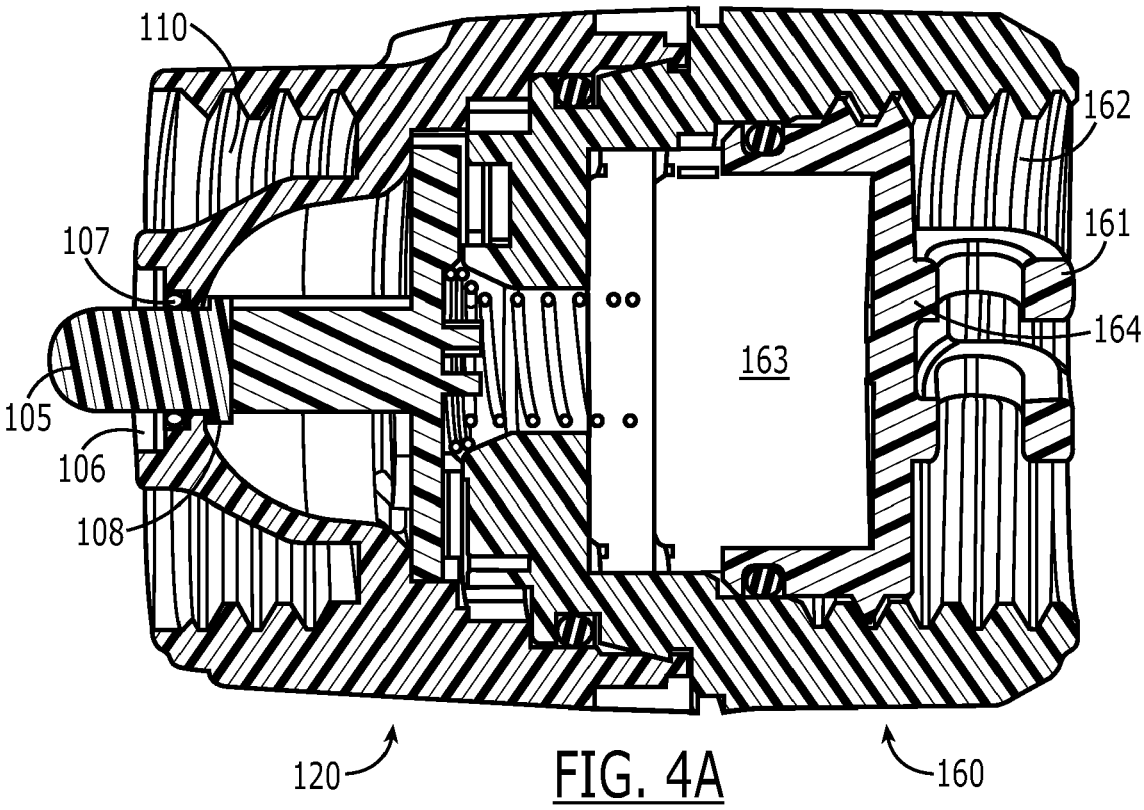
FIG. 4A illustrates a medial cross sectional view of the portable illumination system of FIG. 1.

Reference is next made to FIG. 4A, which illustrates a medial cross sectional view of the portable illumination system of FIG. 1. The distal member 120 includes a recessed distal modular coupler 110. The distal modular coupler 110 is a female threaded coupler that is geometrically shaped and sized to conform to the LAZERBRITE modular coupling scheme of electrical illumination devices and accessories. The electro-optical device 105 is disposed so as to be distally exposed from the distal member 120. The illustrated electro-optical device 105 is a light emitting diode (LED) configured to emit some form of illumination output in response to an electrical input. It will be appreciated that various electrical input and optical output (electro-optical) devices may be utilized in accordance with embodiments of the present invention. For example, the device may be configured to product any one or more types of wavelength output including visual, non-visual, infrared, and ultraviolet lighting may be utilized. The electro-optical device 105 is electrically coupled to an electrical scheme through the interior of the distal and proximal members 120, 160. The electrical scheme and the rotational switching mechanism (see FIGS. 6-7) operate the current flow from the electrical storage device 163 to the electro-optical device 105 with respect to the relative rotational positioning of the distal and proximal members 120, 160. The electro-optical device 105 is pressure sealed through a recess in the distal member 120 to electrically isolate the operation and enable use in a variety of external conditions. One embodiment incorporates a bidirectional seal of the electro-optical device 105 to enable operation at both altitudes (positive exterior pressure) and underwater (negative exterior pressure). The bidirectional seal includes various components to internally/proximally force/bias the LED 105 and lip 108 against a binding region surrounding the recess of the distal member 120 through which the LED 105 is extended. The external/distally oriented portion of the seal includes a washer 106 that surrounds the LED 105 and exerts an opposing force against an O-ring 107 so as to sandwich seal the LED 105 and lip 108 through the recess of the distal member 120.

Figure 4B:
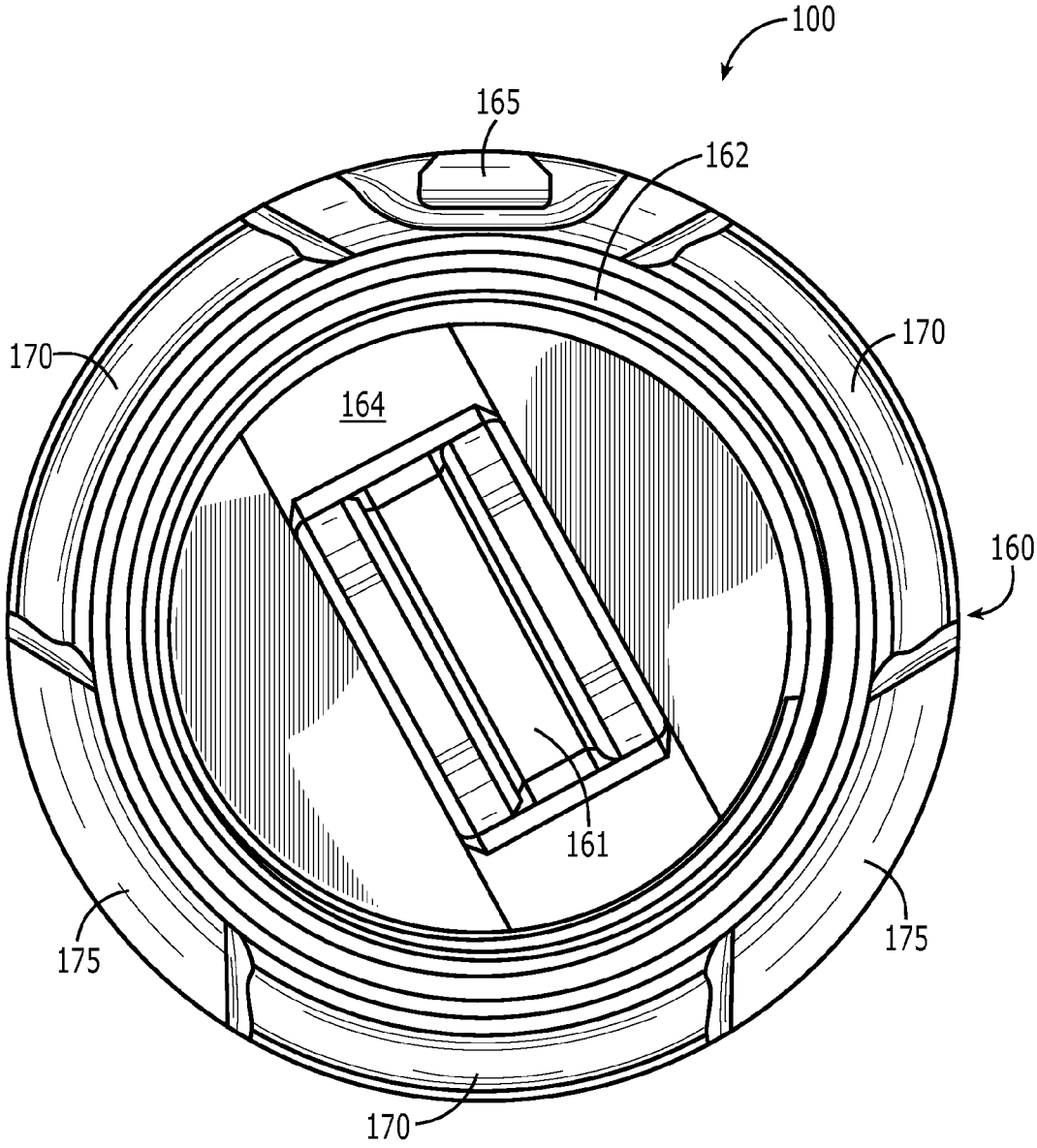
FIG. 4B illustrates a bottom view of the portable illumination system of FIG. 1.
Figure 4C:
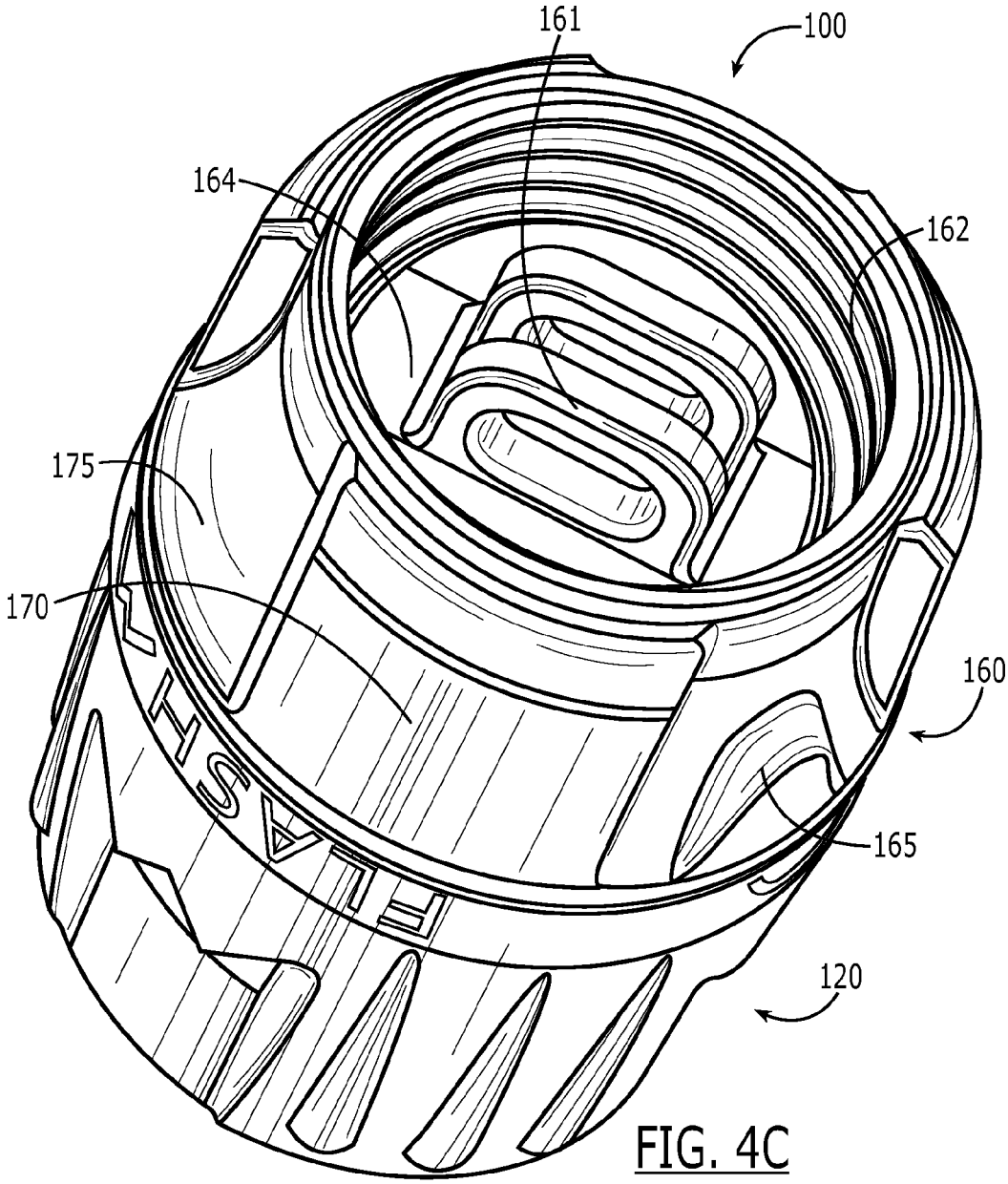
FIG. 4C illustrates a perspective bottom oriented view of the portable illumination system of FIG. 1.

Reference is next made to FIGS. 4B-C, which illustrate various views of the bottom region of the proximal member 160 of the portable illumination system 100. FIG. 4B illustrates the transverse positioning and radial spacing of the proximal indicators 165, 170, 175. A recessed region within the proximal most area includes a modular proximal coupler 162, the electrical storage device 163, and an electrical storage device cover 164 (see FIG. 4A). The modular proximal coupler 162 includes a threaded female region which may be utilized to threadably couple with a corresponding male threaded coupler. The modular proximal coupler 162 is geometrically shaped and sized to conform to the LAZERBRITE modular coupling scheme of electrical illumination devices and accessories. The electrical storage device 163 of the illustrated embodiment is one or more coin-cell type direct current batteries having a positive and negative side. Multiple batteries may be stacked with respective positive and negative sides to act in series. The electrical storage device 163 is disposed within an enclosed region of the proximal member 160 that is covered and air sealed by the electrical storage device cover 164. The electrical storage device cover 164 is threadably coupled via the modular proximal coupler 162 so as to compresses distally against an O-ring that surrounds the electrical storage device 163, thus creating an air and water tight seal that effectively electrically isolates the interior region of the proximal member 160 and the electrical storage device 163 from exterior debris. The electrical storage device cover 164 includes a geometric raised slotted region 161. The geometric raised slotted region 161 enables a user to utilize a particularly sized circular disk to rotate the cover 164 and engage/disengage the seal for purposes of accessing, replacing, inspecting, etc. the electrical storage device 163. The size of the illustrated electrical storage device 163 (coin cell battery) and/or a United States Treasury quarter are properly sized to bind within the geometrically raised region 161. In addition, the geometrical raised slotted region includes transverse recesses through which a lanyard or other attachment device may be threaded.

Figure 5:
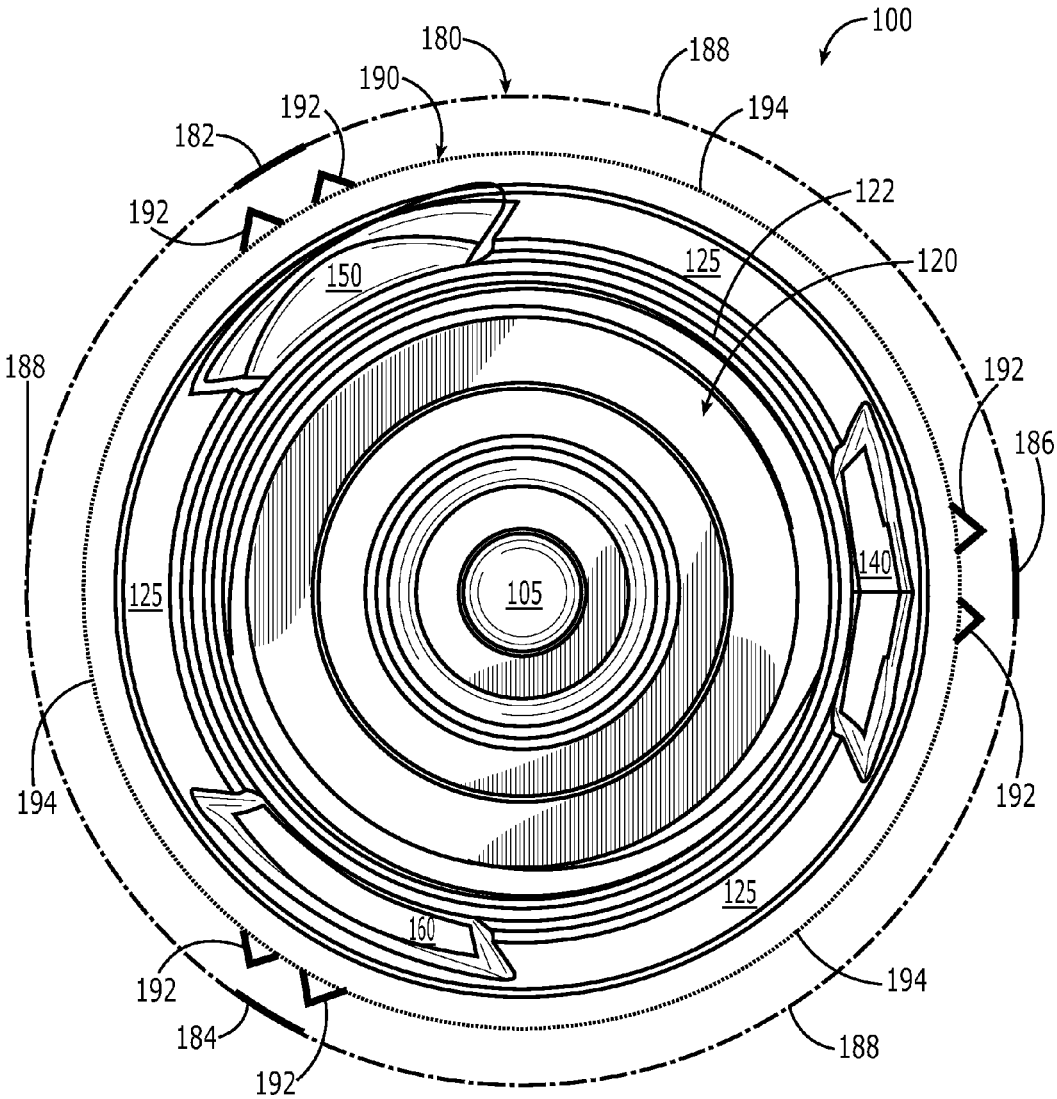
FIG. 5 illustrates a bottom view of the portable illumination system of FIG. 1 including rotational electrical and resistance system profiles.

Reference is next made to FIG. 5, which illustrates a top view of the portable illumination system 100 of FIG. 1, a rotational profile of the electrical system 180, and a rotational profile of the resistance system 190. Transverse positioning and radial spacing of the distal tactile indicators 140, 150, 160, 125 are illustrated. The electrical system profile 180 is a circular graph showing the state of the electrical system when the activated region 167 (see FIG. 1) of the proximal member 160 is linearly aligned with a particular region of the distal member 120. Therefore, the illustrated radial alignment of the electrical system profile 180 is rotationally aligned with the illustrated radial positioning of the distal member 120. For example, when the activated region 167 (see FIG. 1) is linearly aligned with the first distal activated tactile indicator 140 (as a result of rotation between the members), the electrical system profile 180 includes a first activated state 186 represented by a solid line across a particular radial region (the illustrated right-most portion of the outer circle). The utilization of a solid line across this region signifies that the electrical system is in some form of activated state across this particular radial region. Likewise, the inactive radial regions 188 at which the electrical system is deactivated are represented by a dashed line. An activated state of the electrical system may refer to any form of illumination output of the electro-optical device 105 including but not limited to on, bright, flashing, dim, etc. Therefore, the rotational positioning of the members 120, 160 necessary to produce the first, second, and third activated states of the electrical systems are correspondingly illustrated by the first, second, and third activated states 186, 182, 184 on the electrical system profile 180, respectively. The rotational profile of the resistance system 190 is also illustrated with respect to a linear alignment of the activated region 167 (see FIG. 1) with the radial positioning of the illustrated distal member 120. In particular, the rotational profile of the resistance system 190 illustrates the radial resistance states 192 of the resistance system as solid lines across regions where rotational resistance is induced or experienced at the rotational coupling between the distal and proximal members 120, 160. The radial resistance states 192 are illustrated as being radially aligned with the positions on the distal member 120 at which the resistance will be induced with respect to the rotational position of the active region 167 of the proximal member 160. The amount or degree of resistance across the regions representing the radial resistance states 192 is approximately illustrated by the amplitude or distance away from the resistance system profile 190. For example, the peak or middle of each of resistance states 192 is a solid line which is furthest from the dashed circle, thereby indicating the highest degree of resistance. The highest resistance points correspond to the positioning at which each activated state 182, 184, 186 of the electrical system begins or ends. The non-resistance states 194 at which no supplementary resistance is induced by the resistance system are represented by the dotted blank regions of the profile 190. The illustrated resistance system profile 190 therefore illustrates that the resistance states 192 are configured to be rotationally or radially adjacent to the activated states 182, 186, 184 of the electrical system. The illustrated resistance system profile 190 also illustrates that the resistance states 192 rotationally preempt and follow the active states 182, 186, 184 of the electrical system with respect to the distal member. In addition, the illustrated resistance system profile 190 illustrates that in a continuous rotational movement of the members 120, 160 from an electrical deactivated state 188, a resistance state 192 will occur before an electrical activation state 182, 184, 186; this will thus translate to a user feeling a rotational resistance before an electrical activation of the electro-optical output device 105. It will be appreciated that the illustrated resistance states 192 are approximate representations for purposes of illustrating rotational positioning rather than the exact tactile feeling felt by a user. For example, the tactile feeling felt by a user may include a more curved and/or gradual resistance profile. In addition, it will be noted that the activated states 182. 186, 184 may be rotationally engaged from two directions thereby facilitating unique switching functionalities. For example, a user may rotationally positions the proximal and distal members to switch between two particular activated states 182, 186, 184 with a single movement.

Figure 6:
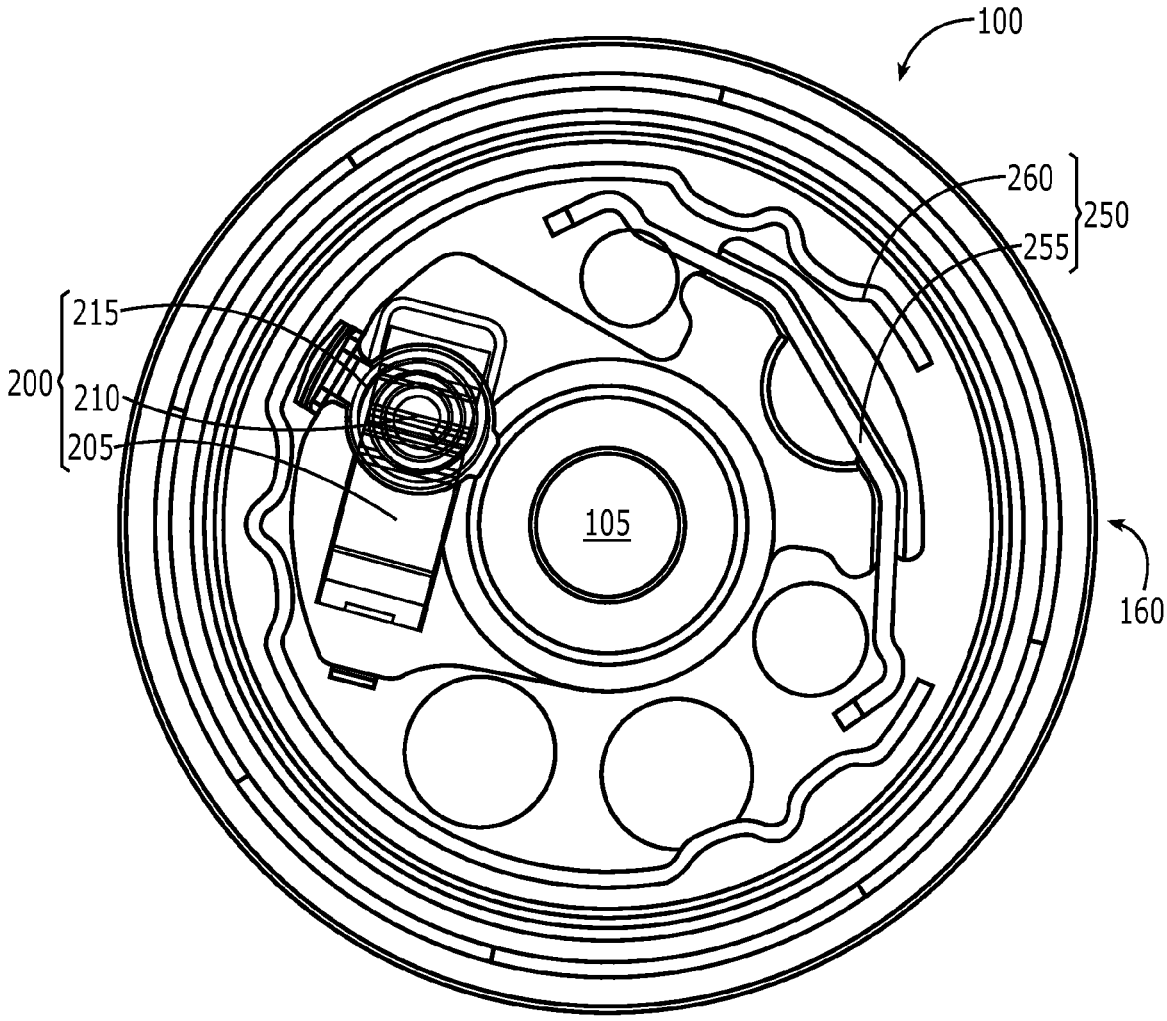
FIG. 6 illustrates a top cross-sectional view of the portable illumination of FIG. 1 illustrating one embodiment of the operationally independent resistance system and electrical switching system.
Figure 7:
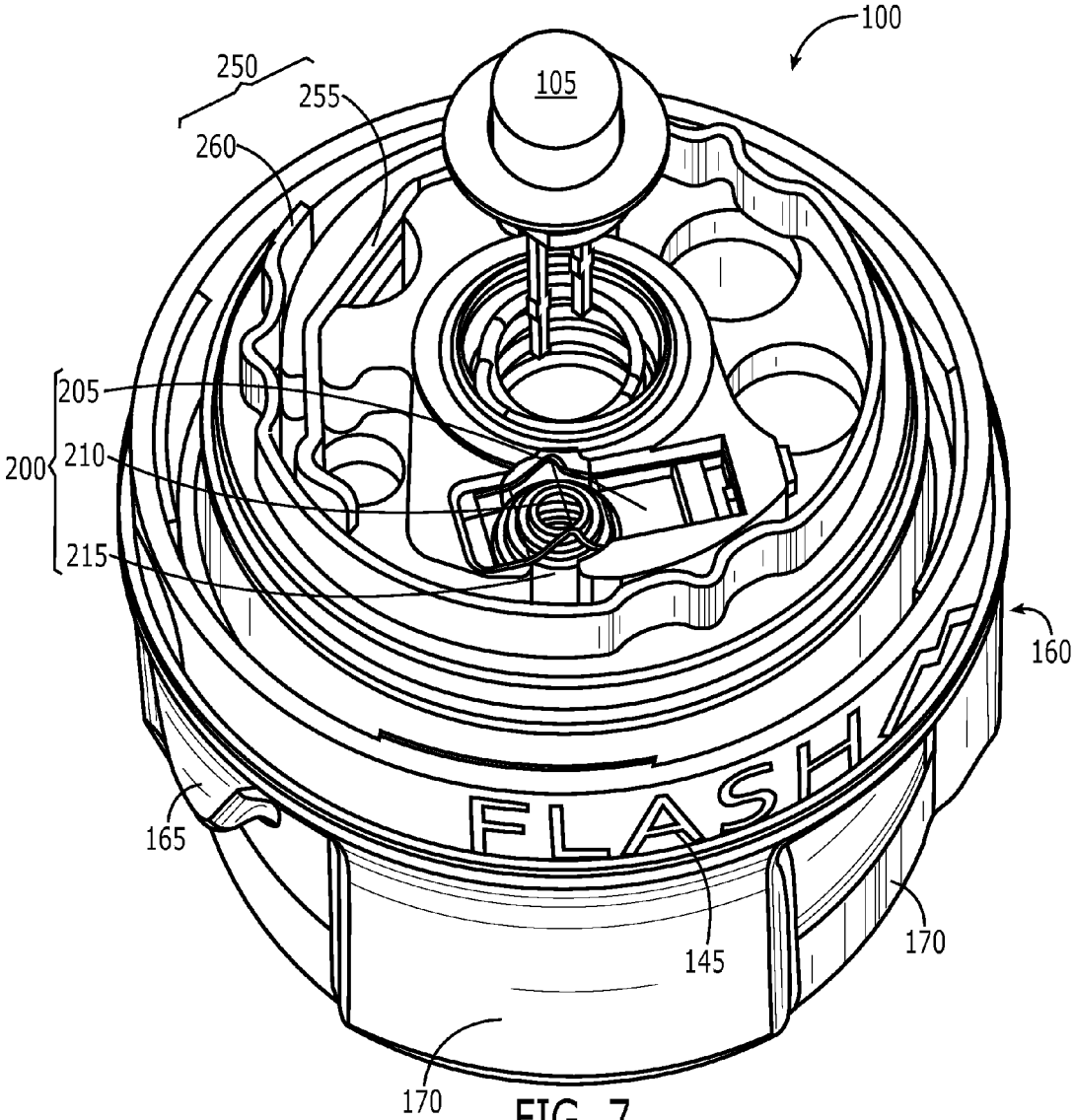
FIG. 7 illustrates a perspective cross-sectional view of the portable illumination of FIG. 1 illustrating one embodiment of the operationally independent resistance system and electrical switching system.

Reference is next made to FIGS. 6-7, which illustrate cross-sectional views of the portable illumination system of FIG. 1, illustrating one embodiment of the operationally independent resistance system 250 and electrical system 200. The resistance system 250 and electrical system 200 are housed within the members 120, 160 in close proximity to one another and operate simultaneously to produce the proper tactile feedback coordinated with illumination output. The resistance system 250 operates to create the resistance states 192 at particular rotational positions between the members 120, 160 (as shown in the resistance system profile 190 of FIG. 5). The resistance states 192 are tactilely felt or experienced by a user during operation or relative rotation of the respective members 120, 160. The resistance system 250 further includes a distal resistance member 255 and a proximal resistance member 260. The distal resistance member 255 is rigidly rotationally coupled to the distal member 120, and the proximal resistance member 260 is rigidly rotationally coupled to the proximal member 160 such that the relative rotation of members 120, 160 causes the relative rotation of the resistance members 255, 260. The proximal resistance member 260 includes an outer channel member within which the distal resistance member 255 is rotated. The resistance between the members 120, 160 corresponds to the relative geometrical rotational resistance between the resistance members 255, 260 according to their rotational alignment with one another. For example, the radial curvatures in proximal resistance member 260 correspond to changes in the degree of resistance. In the illustrated embodiment, the distal resistance member 255 includes two outwardly curved outer regions which rub against the inward oriented curvatures of the proximal resistance member 260. The illustrated proximal resistance member 260 may also be referred to as a detent ring in that it encircles the outer perimeter of the interior region. The illustrated distal resistance member 255 may also be referred to as a leaf spring in that the two outwardly curved outer regions exhibit an outward spring bias to maintain the rubbing against the proximal resistance member 260. Various alternative geometrically shaped and spaced curvature schemes may be utilized and remain consistent with embodiments of the present invention.

The electrical system 200 coordinates the activated states 182, 184, 186 at particular rotational orientations/positions between the members 120, 160 (as shown in the electrical system profile 180 of FIG. 5). As discussed above, the activated states 182, 184, 186 correspond to some form of illumination of the electro-optical device 105. The electrical system 200 further includes a biasing conductive member 205, a ramped conductive member 210, a spring 215, a spacer (not shown), and a printed circuit board (not shown). The biasing conductive member 205 is electrically coupled to the ramped conductive member 210. The biasing conductive member 205 is electrically coupled to the electrical storage device 163 and in conjunction with the spring 215, induces a distal-oriented mechanical bias upon the ramped conductive member 210. The biasing conductive member 205 therefore mechanically operates like a diving board. The spring 215 is disposed directly proximal to the ramped conductive member 210 thereby exerting a constant distal-oriented bias upon the ramped conductive member 210. The conductive members 205, 210 and the spring 215 are rigidly rotationally coupled to the proximal member 160. The spacer and printed circuit board are rigidly rotationally coupled to the distal member 120. Therefore, the relative rotation of members 120, 160 causes the relative rotation of the conductive members 205, 210 with respect to the spacer. The spacer is a circular non-conductive member which includes three recesses radially positioned at particular rotational orientations that correspond with the activated states 182, 184, 186. The recesses are shaped and oriented to correspond with the ramped conductive member 210 such that at proper alignments between the members 120, 160, the ramped conductive member 210 extends distally through the recesses of the spacer and electrically couples with conductive leads on proximal side of the printed circuit board. The active states 182, 184, 186 of the electrical system 200 correspond to rotational positions in which the distal and proximal conductive members 205, 210, 215 are rotationally aligned and/or coupled to facilitate electrically conducting current from the electrical storage device (not visible) to the electro-optical device 105 via the biasing conductive member 205, ramped conductive member 210, and printed circuit board (not shown) respectively. The proximal conductive member 215 is a circular spring member configured to bias distally. In inactive states of the electrical system 200 the spacer prevents electrical coupling between the ramped conductive member 210 and the printed circuit board. In operation, as the members 120, 160 are rotated from an inactive state to an active state, the ramped conductive member 205 coupled to the proximal member 160 rotationally aligns with one of the recesses of the spacer coupled to the distal member 120 to allow for electrical coupling between the ramped conductive member 210 and the printed circuit board. Various alternative conductive coupling and wiring schemes may be utilized in conjunction with the teachings of the present invention.

Various other embodiments have been contemplated, including combinations in whole or in part of the embodiments described above. For example, alternative tactile indicators, alternative resistive feedback rotational profiles, alternative resistive feedback amounts, alternative activated modes, alternative activated electrical rotational profiles, alternative resistive feedback generation system, alternative electrical switching mechanism, etc. in accordance with embodiments of the present invention.

What is claimed is:

1. A portable illumination system comprising:

a distal member including an exterior surface with a plurality of radially separated tactile indicators including a distal activated indicator and a distal deactivated indicator;

a proximal member including an exterior surface with a plurality of radially separated tactile indicators including a proximal activated indicator and a proximal deactivated indicator, wherein the proximal member is rotatably coupled to the distal member, and wherein the rotatable coupling between the members includes resistive rotational feedback across a plurality of independent rotational regions between the members corresponding to a linear alignment between the distal activated indicator and the activated proximal indicator;

an electrical power source;

an electro-optical output device;

a rotational switching mechanism configured to switch between an activated state and a deactivated state, wherein the activated state includes an electrical coupling between the electrical power source and the electro-optical output device across a plurality of independent rotational regions between the members corresponding to a linear alignment between the distal activated indicator and the activated proximal indicator.

2. The portable illumination system of claim 1, wherein the plurality of independent rotational regions of resistive rotational feedback partially overlap with the plurality of independent rotational regions of the activated state.

3. The portable illumination system of claim 1, wherein the plurality of independent rotational regions of resistive rotational feedback are coordinated to rotationally preempt and follow the plurality of independent rotational regions of the activated state.

4. The portable illumination system of claim 1, wherein the plurality of independent rotational regions are rotationally aligned to substantially preempt and follow the linear alignment of the distal activated indicator with the proximal activated indicator.

5. The portable illumination system of claim 1, wherein the resistive rotational feedback includes a rotational region of increasing rotational resistance between the proximal and distal members.

6. The portable illumination system of claim 1, wherein the resistive rotational feedback includes regions having a bell shaped rotational resistance profile with progressive and regressive rotational resistance between the proximal and distal members.

7. The portable illumination system of claim 1, wherein the electrical power source is substantially enclosed within the proximal member, and wherein the electro-optical output device is substantially enclosed within the distal member, and wherein the electro-optical output device is in part externally exposed with respect to the portable illumination system to enable an optical output in the activated state.

8. The portable illumination system of claim 1, wherein the exterior surface of the distal member includes a second distal activated indicator radially separated from the distal activated and distal deactivated indicators, and wherein the rotational alignment of the second distal activated indicator with the proximal activated indicator corresponds to a secondary activated state of the rotational switching mechanism, and wherein the secondary activated state includes an electrical coupling between the electrical power source and the electro-optical output device so as to produce a second optical output that varies from a first optical output by at least one optical characteristic.

9. The portable illumination system of claim 1, wherein the distal and proximal members each include a linearly oriented modular coupler, and wherein the electro-optical output device is an LED, and wherein the electrical power source is a battery.

10. A portable illumination system comprising:

a distal member;

a proximal member, wherein the proximal member is rotatably coupled to the distal member;

an electrical power source;

an electro-optical output device;

a rotational switching mechanism configured to switch between an activated state and a deactivated state, wherein the activated state includes an electrical coupling between the electrical power source and the electro-optical output device, and wherein the rotational switching mechanism includes an electrical switching system and an operationally independent resistance system, and wherein the electrical switching system defines a plurality of rotational regions between the members corresponding to the activated state, and wherein the resistance system defines a plurality of rotational regions between the members at which resistive rotational feedback is generated between the members, and wherein the plurality of rotational regions defined by the resistance system are coordinated with the plurality of rotational regions defined by the electrical switching system so as to rotationally preempt and follow the plurality of rotational regions corresponding to the activated state.

11. The portable article of claim 10, wherein the electrical switching system includes a first conductive member electrically coupled to the electrical power source, and wherein the first conductive member includes a mechanically biased region, and wherein the electrical switching mechanism includes a second conductive member electrically coupled to the electro-optical output device.

12. The portable article of claim 11, wherein the activated state corresponds to the first conductive member electrically and mechanically coupled to a second conductive member, wherein the mechanical coupling includes lengthwise biasing a portion of at least one of the first and second conductive member such that at the rotational regions corresponding to the activated state, the portion of the at least one of the first and second conductive member is automatically translated to engage the electrical coupling between the first and second conductive members.

13. The portable article of claim 10, wherein the distal member includes an exterior surface with a plurality of radially separated tactile indicators including a distal activated indicator and a distal deactivated indicator, and wherein the proximal member includes an exterior surface with a plurality of radially separated tactile indicators including a proximal activated indicator and a proximal deactivated indicator, and wherein the activated state corresponds to a linear alignment between the distal activated indicator and the proximal activated indicator.

14. The portable article of claim 10, wherein the resistance system includes an outward radially biasing member and circumferential channel member, and wherein the rotational alignment and corresponding geometries of the outward radially biasing member and the circumferential channel member define the quantity of rotational resistance generated by the resistance system.

15. The portable article of claim 10, wherein the plurality of rotational regions defined by the electrical switching system are substantially different than the plurality of rotational regions defined by the resistance system, and wherein the plurality of rotational regions defined by the electrical switching system overlap with the plurality of rotational regions defined by the resistance system.

16. The portable article of claim 10, wherein the plurality of rotational regions defined by the electrical switching system include electrically active regions and the plurality of rotational regions defined by the resistance system include bell shaped resistive feedback regions, and wherein the bell shaped resistive feedback regions are rotationally oriented substantially adjacent to the electrically active regions with respect to the rotational alignment of the members.

17. A method for rotationally activating a portable illumination system comprising the acts of:

providing a distal member;

providing a proximal member;

providing a rotational switching mechanism including an activated state and a deactivated state, wherein the activated state includes an electrical coupling between an electrical storage device and an electro-optical output device so as to produce an optical output;

positioning the rotational switching mechanism in the deactivated state;

rotating the distal member relative to the proximal member;

inducing a rotational resistance between the distal and proximal members across a rotational region; and engaging the activated state at a rotational position within the rotational region.

18. The method of claim 17, wherein the act of inducing a rotational resistance between the distal and proximal members across a rotational region includes inducing a rotational resistance having a bell shaped rotational profile including regions of progressive and regressive resistance.

19. The method of claim 17, wherein the act of engaging the activated state at a rotational position within the rotational region includes linearly aligning an activated tactile indicator on an exterior surface of the distal member with an activated tactile indicator on an exterior surface of the proximal member.

20. The method of claim 17, wherein the act of engaging the activated state at a rotational position within the rotational region includes mechanically biasing and coupling a first conductive member electrically coupled to the electro-optical output device with a second conductive member electrically coupled to the electrical storage device.

* * * * *